US006912817B1

(12) United States Patent
Sabac et al.

(10) Patent No.: US 6,912,817 B1
(45) Date of Patent: Jul. 5, 2005

(54) RESTRAINT CHANNEL SYSTEM FOR RETAINING IMPACT PANEL

(76) Inventors: Steven R. Sabac, 4541 White Feather Trail, Boynton Beach, FL (US) 33436; Jason J. Kromolicki, 6834 Windwillow Dr., New Port Richey, FL (US) 34655

( * ) Notice: Subject to any disclaimer, the term of this patent is extended or adjusted under 35 U.S.C. 154(b) by 0 days.

(21) Appl. No.: 09/457,631

(22) Filed: Dec. 8, 1999

Related U.S. Application Data

(60) Provisional application No. 60/111,608, filed on Dec. 10, 1998.

(51) Int. Cl.[7] ..... E06B 3/30

(52) U.S. Cl. ..... 52/204.54; 52/204.7; 52/204.69; 52/204.71; 52/212; 52/214

(58) Field of Search ..... 52/204.54, 211, 52/212, 214, 204.71, 204.53, 204.7, 204.62, 204.69

(56) References Cited

U.S. PATENT DOCUMENTS 5,426,897 A * 6/1995 Gazaway ..... 52/204.53
D393,083 S * 3/1998 Caltrider ..... D25/199

* cited by examiner

*Primary Examiner*—Carl D. Friedman
*Assistant Examiner*—Yvonne M. Horton
(74) *Attorney, Agent, or Firm*—McHale & Slavin, P.A.

(57) ABSTRACT

The invention generally discloses a means for securing an impact resistant panel within a frame by utilizing a restraint channel system. One common type of impact resistant panel may be a piece of glass that has been covered substantially on one face with a window film. The present invention more particularly discloses a channel resistant system for retaining an impact resistant piece of glass, that has been covered substantially on one face with a window film, within a frame, by utilizing a

7 Claims, 6 Drawing Sheets

RESTRAINT CHANNEL SYSTEM FOR RETAINING IMPACT PANEL

Figure 1:
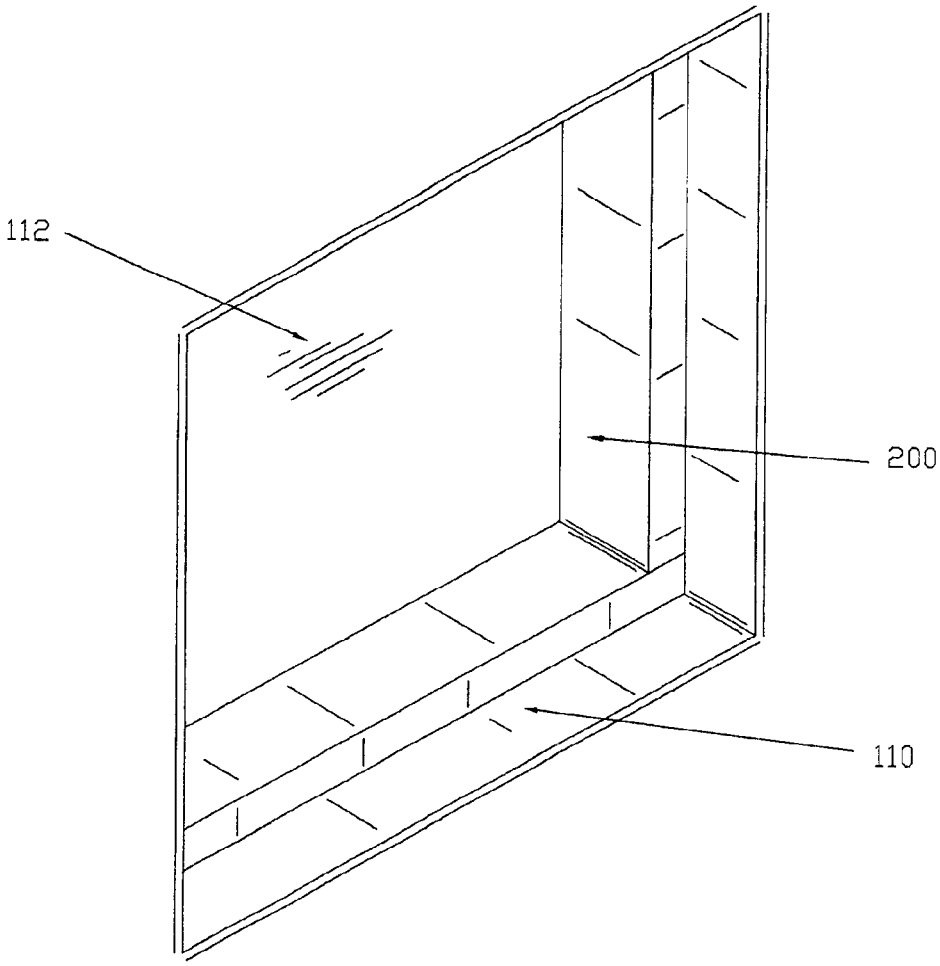

This application claims the benefit of provisional application Ser. No. 60/111,608 filed on Dec. 10, 1998.

BACKGROUND OF THE INVENTION

1. Field of the Invention

The invention generally relates to an means for securing an impact resistant panel within a frame by utilizing a restraint channel system. One common type of impact resistant panel may be a piece of glass that has been covered substantially on one face with a window film.

2. Description of the Prior Art

For many years, polyester laminates, ie. "window films" have been applied to windows for many purposes, including solar and uv rejection, and safety reasons. Certain thicker window films, deemed safety films, have gradually been developed as to contain sufficient tensile strength to hold the glass, glass particles, or a great number of the particles together in the event of breakage. It was discovered that without a means of attaching this piece of coated glass to the window frame, the entire piece of coated glass, if broken would become completely dislodged from the frame during loading. Gross et al. U.S. Pat. No. 4,075,802 addresses this problem by disclosing that the film is adhesively secured to the glass and a thin contoured strip is placed over the film edges and held in place with wood screws. This device seems particularly suited to wooden window frames found primarily within the residential market, and does not address a means of adequately securing the coated glass to commercial window frames in an aesthetically pleasing manner.

Gazaway et al. U.S. Pat. No. 5,426,897 discloses an improved apparatus insuring securement for common flat glass (common commercial and storefront) windows with an aesthetically pleasing appearance. Basically, the apparatus involves a film adhesively attached to the glass and held in place with a clamping securing means. The "securing means" includes cutting the piece of film larger than the glass and overlapping it onto the existing window frame. The film is held onto the frame with a thin strip of adhesive tape, and screwed in place with a trough shaped baseplate, virtually securing the film between the existing window frame and the baseplate. A cap is snapped into a groove in the baseplate to cover the unsightly overlapped film and screws and provide a more aesthetic appearance. A thin flexible gasket is engaged on the cap to maintain a sealing pressure and protect the area from moisture and other contaminants. This apparatus provides an adequate means of glass retention, yet the numerous cumbersome steps make the system labor intensive and extremely difficulty to install even for those skilled in the art of film installation. As a result of this difficulty, and the numerous materials involved, the system is also expensive.

These earlier systems rely on a film extension beyond the glass to the frame. Therefore, these systems may not be conducive to utilize other types of impact resistant panels.

SUMMARY OF THE INVENTION

Therefore, it is an objective of the present invention to provide an improved means of not only insuring retention of coated glass but any type of impact resistant panel within a frame.

It is also an objective of the present invention to provide an improved means of attaching the impact resistant panel to the existing frame by use of a structural means.

Furthermore, it is an objective of the present invention to provide an apparatus of the type described below including the use of an adhesive binder to adequately secure the impact resistant panel to a frame.

Generally, a preferred embodiment of the present invention includes an impact resistant panel, and a channel to conceal the adhesive for affixing the Impact resistant panel to a frame. For example, if using window film as the impact resistant panel, the existing glass is coated with the window film utilizing normal window film installation techniques, those techniques being the film is applied to glass with a water solution, squeegeed in place, and excess film is trimmed off at the point where the glass meets the existing window frame or mullion. The securing means may include a structural adhesive binder and a double chambered L-shaped retaining mullion. The L-shaped retaining mullion is extruded so that it is smooth on the exterior, and has a curved shaped dividing angle protruding from the interior of the mullion. The mullions are precut to the size of the window, structural adhesive is applied to both chambers of the mullion along the length of the mullion, and the adhesive treated mullion is pushed into place creating a double adhesive binder along the edge of the film as well as the edge of the existing window frame. This binder acts as a structural bridge that spans the normal window gasket. The smooth exterior of the L-shaped retaining mullion provides an aesthetically pleasing appearance.

Alternately, the channel may be formed to allow for the channel to be screwed or fastened to the frame while retaining the characteristics for attaching the impact resistant panel to the channel. In either case, the structural adhesive is contained within the channel for an aesthetically pleasing appearance while allowing the structural adhesive to cure by use of airflow chamber(s). The two part assembly with the channel and the cap has a cap that is designed to be slightly shorter than the channel. This allows for a void to be created between the cap and the panel when the two parts are joined together, therefore, facilitating the proper airflow means by which the structural adhesive can cure.

An advantage of the present invention is that it provides a secure means of attaching an impact resistant panel to an existing frame in an aesthetically pleasing manner utilizing a far less cumbersome and complicated means, including less labor and materials than those systems previously offered. A one piece channel not only eliminates the multiple material but also the multiple cuts, predrilling, and screwing of system in place. Both the one piece channel and screwed down channel eliminate the need for the film to be wrapped on the frame, and allow for the use of other impact resistant panels, thus eliminating the need for film altogether in these circumstances.

A further advantage of the present invention is the cutting of the film along the existing window frame edge (how window film is normally installed) instead of overlapping it thereby creating a drastic ease of installation over previous systems. The use of common place window film application techniques dramatically cuts installation time by first, not having to pre-cut the material larger than the glass, an extremely time consuming process as film must be meticulously cut so that it is square and will form an exact fit into the existing window frame. Secondly, cutting along the edge eliminates the actual overlapping or bending of the film, also a time consuming process as the film must be pre-bent and pushed into the frame. The use of common place film application techniques also allows for greater utilization of the current skilled labor pool.

In addition, cutting the film along the edge instead of overlapping allows for a dramatically improved ability to utilize thicker window film laminates with higher tensile strengths that previously would have been near impossible to overlap. For example, the thicker the film the more memory it retains when bent. This causes difficulty in keeping the overlapped film in place before it cures to the glass and frame. Cutting the film along the edge will eliminate this problem. These higher tensile strength films allow the system as a whole to perform better, achieving greater impact and cyclical resistance and improved water penetration resistance.

Furthermore, the present invention allows for the use of different channel body configurations which can dramatically improve the performance of the channel restraint system and allow for multiple uses of the impact resistant system. For example, by configuring the design of the channel to remain rigid would allow the system to withstand repetitive wind load cycles, such as with long duration hurricane force winds, and would not fatigue the channel because of this rigidity. On the other hand, a channel designed to be more conducive to flex, thus allowing the channel body to act as a shock absorber or crumple zone would help dissipate a major instantaneous force, such as with a bomb blast load, moving th force away from the adhesive and helping to distribute it throughout the entire resistant channel system. Varying the body configurations and wall thickness of the channels' impact absorption arm allows the channel to slow the impact load at different rates to help control and distribute the load.

The objective of this embodiment is like that illustrated in FIGS. 1–6 as an improved means of securing a broader range of impact resistant panels within a frame. While these six embodiments may all illustrate channel systems that will accomplish the objective, it will be apparent to those skilled in the art that many other channel configurations will accomplish the same task. It is therefore understood that any variation thereof will fall under the occurring claims and within the scope of this invention.

IN THE DRAWINGS

FIG. 1. Preferred embodiment of the present invention in a window frame

Figure 2:
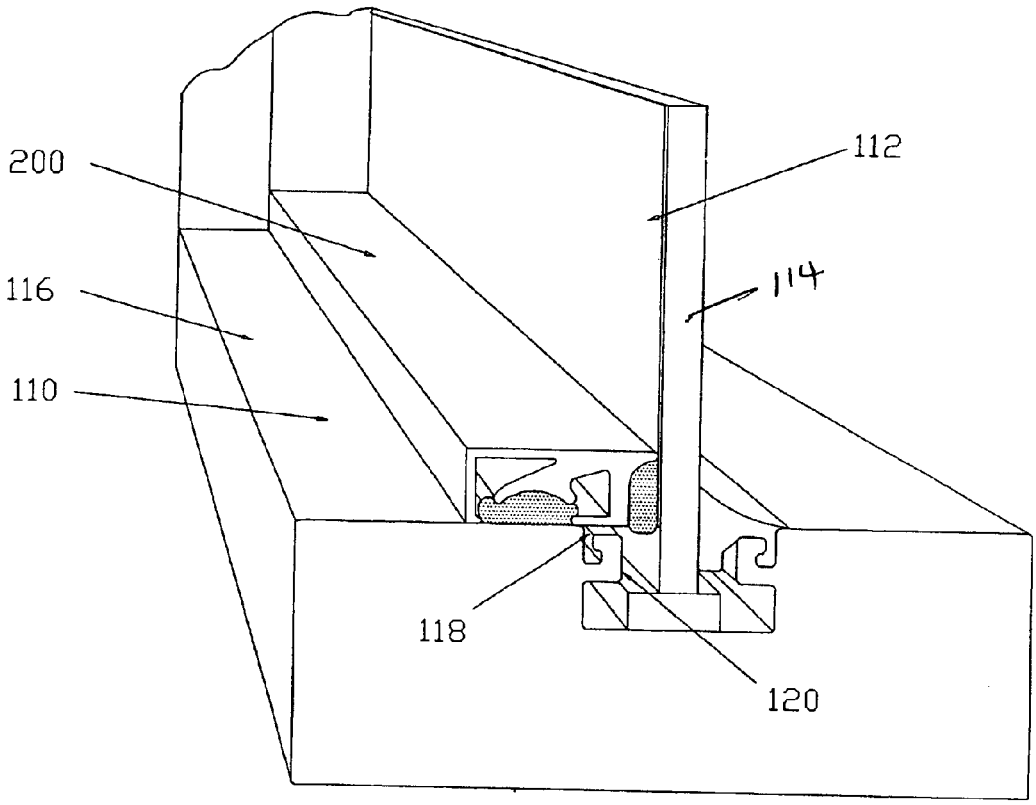
Figure 3:
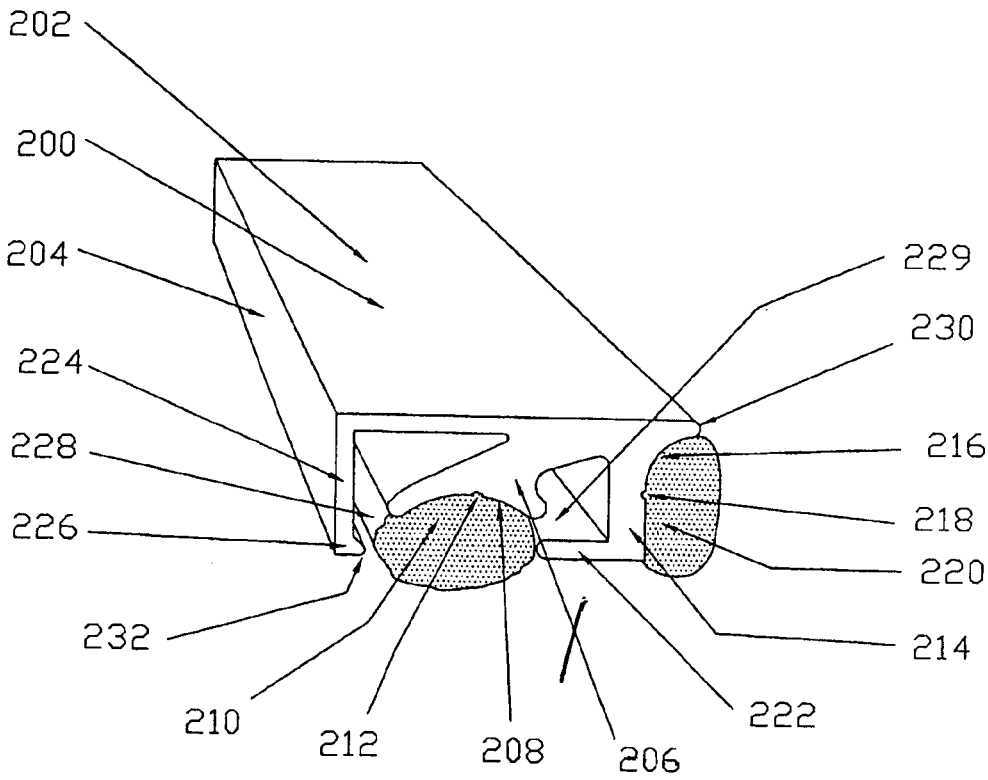

FIG. 2. Cross section of a further detail of the channel within a window frame FIG. 3. Detailed drawing of an example channel further detail of the channel as illustrated in FIG. 2.

Figure 4:
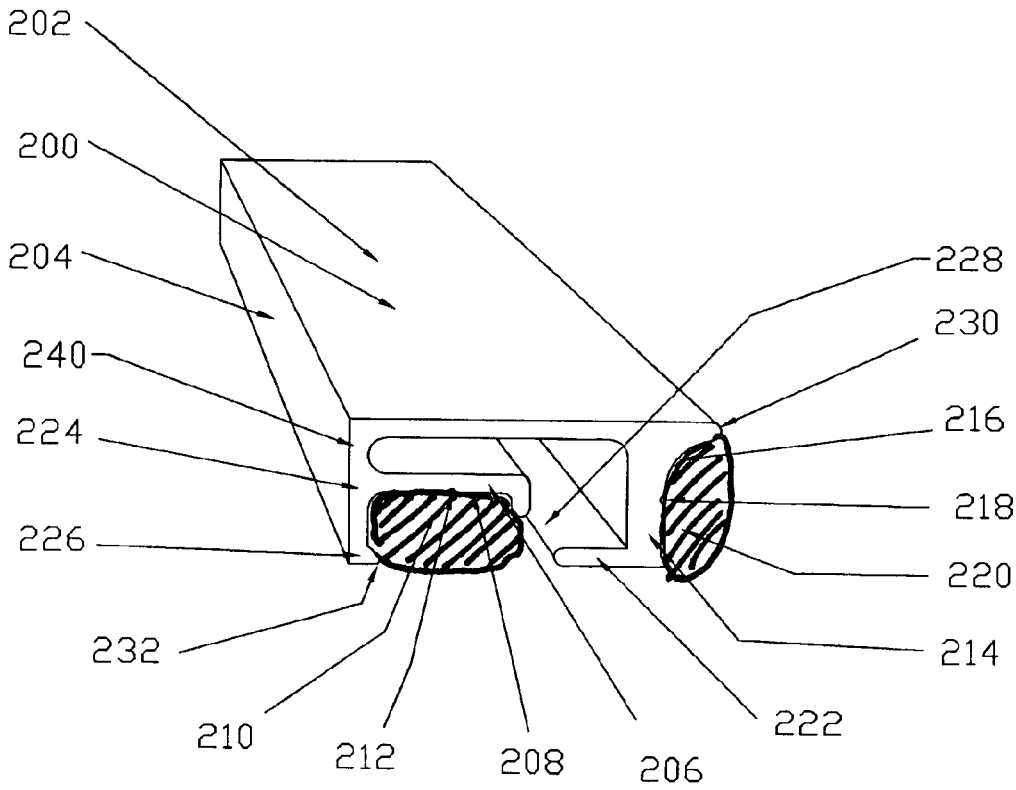

FIG. 4. Detailed drawing of an example channel with an impact absorption arm FIG. 5. Detailed drawing of an example channel with a single structural adhesive surface FIG. 6. Detailed drawing of an example channel with cap

Detailed Description of Preferred Embodiment

FIG. 1 shows the preferred embodiment of the present invention in a frame. An impact resistant panel 112 is secured to the frame 110 by means of the channel 200 in accordance with the present invention.

FIG. 2 shows a further detail of the channel 200 and the frame 110. Detailed drawings of the channel 200 can be seen in FIGS. 3 and 4. Referring to FIG. 4, the channel 200 includes a horizontal extremity 206 that protrudes downward from the top 202 of the channel 200. The horizontal extremity 206 is secured to the frame 110 by the use of a structural adhesive 210. The structural adhesive 210 is applied to the curved surface 208, shown in FIGS. 2 and 3. An alignment groove 212 allows for accurate application of the structural adhesive 210 to the curved surface 208. The horizontal extremity 206 does not come in direct contact with the top 116 of the window frame 110. This is to prevent areas of high stress concentration in the structural adhesive 210.

Furthermore, a vertical extremity 214 protrudes downwardly from the top 202 of channel 200. The structural adhesive 220 is applied to the surface 216 of said vertical extremity 214. An alignment groove 218 allows for the accurate application of the structural adhesive 220 to the surface 216 of the vertical extremity 214. The front edge, of the channel 200, has a curved surface 230 to prevent a fatigue failure of the film during repeated stress cycles. The channel 200 is preferably extruded having an "L" shape cross-section, a smooth top 202 and side 204, and a horizontal extremity 206 or curved surface 208 and vertical extremity 214 extending the length of the channel 200.

A support base 222 extends horizontally from the vertical extremity 214. The support base 222 allows for channel 200 to be pushed into place on a frame 110 where as the top of the frame 116 does not come in direct contact with the impact resistant panel 112. An additional function of the support base 222 is to prevent adhesive 210 from squeezing into the void 118 between the top of the frame 116 and the impact resistant panel 112. This is significant during compression resulting from push in placement of channel 200. This is crucial if replacement/reinstallation of channel 200 is necessary the adhesive 210 would be extremely difficult to cut from the void 118. The support base 222 is designed not to encounter the impact resistant panel 112. This is to allow for adhesive 220 to be directed downward during push in application of channel 200. Also, said directing prevents adhesive 220 from extending beyond top 202 of channel 200 where a visually unappealing circumstance would result.

A further support leg 224 extends downward from the top 202 of the channel 200. This support leg 224 serves as a second support point and makes up the side 204 of the channel 200. An angled directing tap 226 at the base of the support leg 224 prevents adhesive 210 from squeezing beyond the side 204 of the channel 200 during push in placement of channel 200 by directing the adhesive 210 into an airflow chamber 228. Airflow chambers 228 and 229 also serve as a means for adhesive 210 to cure. The angled tab 226 has a curved surface 232 to prevent cutting of the adhesive 210 during horizontal movement resulting from repeated stress cycles.

Alternatively, the adhesive 210 and adhesive 220 maybe applied to the area close to the frame void 118. One bead being applied to the top of the frame 116 and the other bead being applied to the impact resistant panel 112. The channel 200 is then positioned in place, covering both adhesive 210 and adhesive 220.

FIG. 4 further includes an impact absorption arm 240 located at the location where the top 202 of channel 200 meets the support leg 224. This area is crucial during impact shock loading as in the case of bomb blasts. In which the impact absorption arm 240 serves as a shock absorber to help dissipate the applied load. This shock-absorbing characteristic of the impact absorption arm 240 allows for less of the load to be taken by the adhesive 220, allowing for better securement of impact resistant panel 112 to channel 200.

Figure 5:
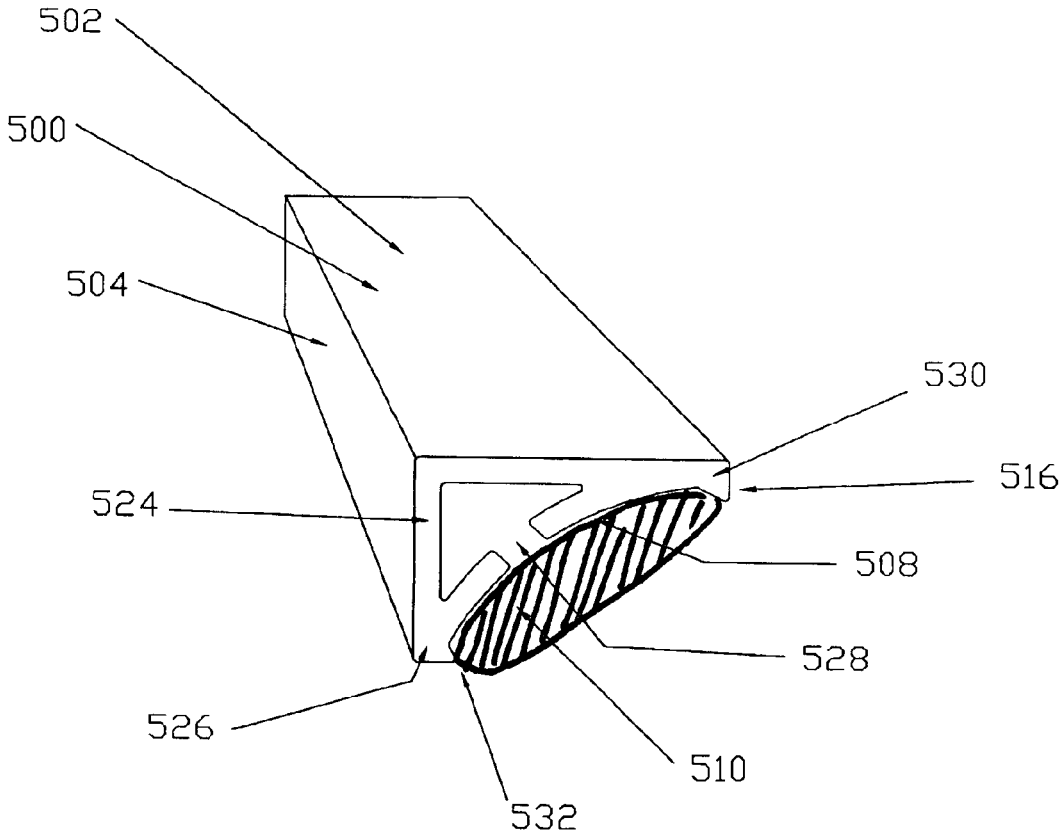

FIG. 5 shows a further detail of the channel 500 being made up of the exposed top 502 and side 504. Protruding downward from top 502 of the channel 500 is a support leg 524 which makes up the side 504 of the channel 500. An angled tab 526 at the base of the support leg 524 serves to further stabilize the channel 500 and to direct the adhesive 510 upward during push in placement of channel 500. The angled tab 526 has a curved surface 532 to prevent cutting of adhesive 510 during horizontal movement resulting from repeated stress cycles. An angled directing tab 530 at the front edge of the top 502 of the channel 500 serves to further stabilize the channel 500 and to direct the adhesive 510 downward during push in placement of channel 500. The angled tab 530 has a curved surface 516 to prevent cutting of adhesive 510 during vertical movement resulting from repeated stress cycles. Connecting angled directing tabs 530 and 526 is a curved surface 508, which the adhesive 510 is applied to. The airflow cavity 528 is the void within the curved surface 508. This airflow cavity 528 serves as an overflow chamber for adhesive 510 and as a means for adhesive 510 to cure.

Alternatively, the adhesive 510 applied to the area close to the frame void 118. The adhesive 510 would be applied in such a way as to contact the top of the frame 116 and/or the inside edge of the frame 120, and the impact resistant panel 112. The channel 500 is then positioned in place, covering the adhesive 510.

Figure 6:
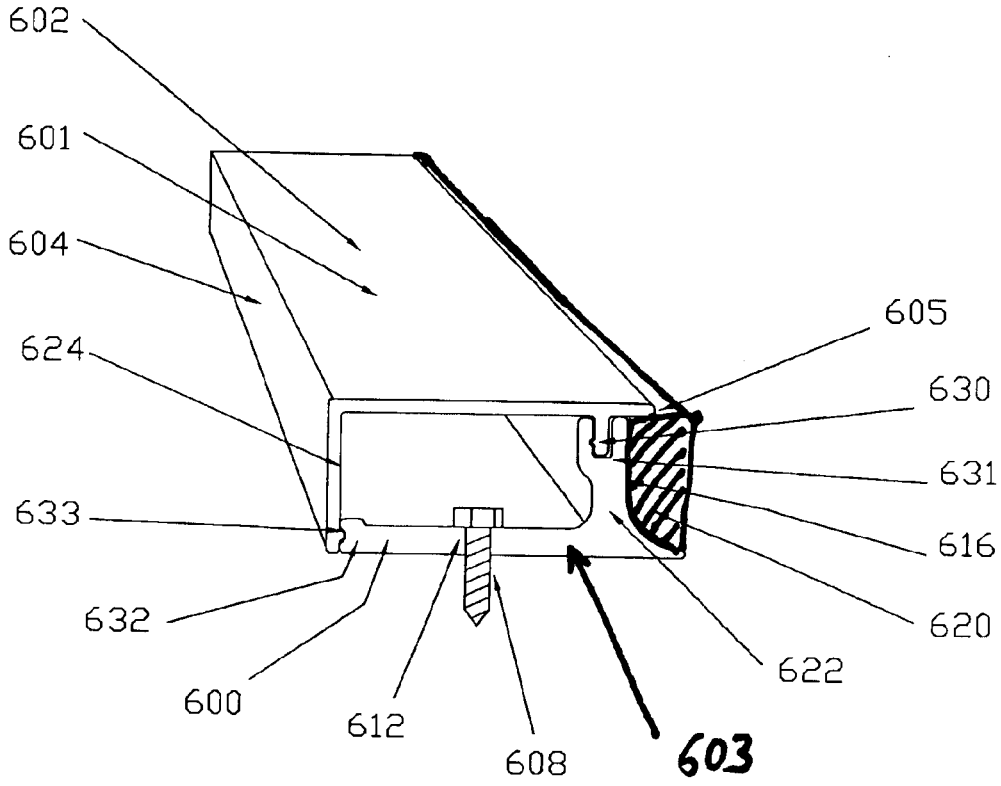

FIGS. 6 shows a detail of the channel 600 and cap 601. The cap 601 has exposed top 602 and side 604. The support leg 624 protrudes downward from the top 602 of the cap 601 and makes up the side 604 of the cap 601. A rib 633 protrudes inward from the support leg 624 near the bottom of the support leg 624. An extension rib 630 protrudes downward from the top 602 of the cap 601 near the front edge. A vertical extremity 622 extends upward from the base segment 603 of channel 600 and has a slot 631 carved in the top portion in order to mate with the extension rib 630 of the cap 601. The adhesive 620 is applied to the surface 616 of the vertical extremity. A grove 632 is located in the edge of the base segment 603 opposite the vertical extremity 622. This grove 632 serves to mate with the rib 633 of the cap 601. A series of holes 612 located along the length of the base segment 603 allow for a fastener 608 to be placed through and fastener 608 to be secured to the frame 116.

The cap is narrower than the channel 600 to allow for a gap 605 between cap 601 and the impact resistant panel 112. This gap 605 allows for the adhesive 620 to cure.

The channel 600 is secured to the top of the frame 116 with fasteners 608, the adhesive 620 is then pumped into the void between the vertical extremity 622 and the impact resistant panel 112, and the cap 601 is then placed over the channel 600.

What is claimed is:

1. A channel restraint system in combination with an impact resistant panel disposed within a frame wherein the channel restraint system comprises:

a channel having an elongate top and elongate sides disposed approximately perpendicular to each other, and elongate vertical extremity means spaced from said elongate side, and a horizontal extremity depending from said top between said side and said vertical extremity means; said channel being positioned adjacent said frame and to one side of said impact resistant panel such that a void is defined between the channel and the frame;

said channel restraint system further comprising an adhesive that is confined within said channel by said vertical extremity means such that said channel is securely bonded to said impact resistant panel and frame thereby preventing the adhesive from entering into said void.

2. A channel restraint system as claimed in claim 1 in which said adhesive forms a structural bond between said impact resistant panel and said frame.

3. A channel restraint system as claimed in claim 2 in which an air flow chamber is formed in said channel between said horizontal extremity and said top, said chamber extending the entire length of the channel whereby said adhesive comes in direct contact with air to cure said adhesive.

4. A channel restraint system as claimed in claim 3 in which said adhesive overflows into said air flow chamber during compression.

5. A channel restraint system as claimed in claim 1 in which said adhesive forms a structural bond between said impact resistant panel and said channel while said channel is secured to said frame by a fastening means.

6. A channel restraint system as claimed in claim 5 in which an air flow chamber is formed in said channel between said horizontal extremity and said top, said chamber extending the entire length of the channel whereby said adhesive comes in direct contact with air to cure said adhesive.

7. A channel restraint system as claimed in claim 6 in which said adhesive overflows into said air flow chamber during compression.

* * * * *